US007536116B2

(12) United States Patent
Yamasaki et al.

(10) Patent No.: US 7,536,116 B2
(45) Date of Patent: May 19, 2009

(54) IMAGE FORMING APPARATUS WITH A PLURALITY OF DEVELOPMENT DEVICES

(75) Inventors: Naoya Yamasaki, Kanagawa (JP); Shunichiro Shishikura, Kanagawa (JP); Masayuki Aratake, Kanagawa (JP); Shigeru Tsukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 447 days.

(21) Appl. No.: 11/350,034

(22) Filed: Feb. 9, 2006

(65) Prior Publication Data

US 2006/0290951 A1 Dec. 28, 2006

(30) Foreign Application Priority Data

Jun. 27, 2005 (JP) ..... P2005-185952

(51) Int. Cl.
*G03G 15/00* (2006.01)
*G03G 15/08* (2006.01)
*G03G 15/01* (2006.01)

(52) U.S. Cl. ..... 399/12; 399/13; 399/27; 399/227

(58) Field of Classification Search ..... 399/27–30, 399/54, 61–64, 223, 227, 12, 13
See application file for complete search history.

(56) References Cited

U.S. PATENT DOCUMENTS 4,620,783 A * 11/1986 Tanaka et al. ..... 399/27
6,009,293 A * 12/1999 Takami ..... 399/227
7,027,746 B2 * 4/2006 Suzuki et al. ..... 399/27
7,065,304 B2 * 6/2006 Taguchi ..... 399/12
7,177,556 B2 * 2/2007 Ishibashi et al. ..... 399/27
7,366,430 B2 * 4/2008 Shishikura et al. ..... 399/9
2006/0067738 A1 * 3/2006 Ohara et al. ..... 399/227
2006/0291873 A1 * 12/2006 Shishikura et al. ..... 399/13

FOREIGN PATENT DOCUMENTS

JP 07199574 A * 8/1995
JP 11-38755 A 2/1999
JP 11-174797 A 7/1999
JP 2001056607 A * 2/2001
JP 2001-66873 A 3/2001
JP 2003-98789 A 4/2003
JP 2004004990 A * 1/2004

* cited by examiner

*Primary Examiner*—Robert Beatty
(74) *Attorney, Agent, or Firm*—Morgan, Lewis & Bockius LLP

(57) ABSTRACT

An image forming apparatus includes a rotary unit that has a rotary shaft, and a plurality of development devices each of which has a constituent unit, the development devices provided around the rotary shaft; and a plurality of state detection units that detects at least one of states of the development devices and states of the constituent unit; wherein the rotary unit is rotated so that the development devices sequentially pass a development position facing a photosensitive member; wherein when any of the development devices is located at the development position, the development device makes an electrostatic latent image on the photosensitive member visible; and wherein each of the state detection units detects at least one of the development devices and the states of the constituent unit during a single stop of rotation of the rotary unit.

12 Claims, 4 Drawing Sheets

IMAGE FORMING APPARATUS WITH A PLURALITY OF DEVELOPMENT DEVICES

BACKGROUND OF THE INVENTION

1. Field of the Invention

The present invention relates to an electrophographic image forming apparatus which makes an electrostatic latent image visible on an image carrier using a development device and enables printed output of a visible image on a recording medium.

2. Description of the Related Art

An image forming apparatus compatible with a color image has recently become common. Some pieces of image forming apparatus compatible with a color image have four development devices assigned to respective color components of YMCK, and a rotary (revolving body) unit having the development devices provided around a rotary shaft. In the image forming apparatus having such a configuration, the respective development devices integrally rotate in association with rotation of the rotary unit, whereby the development devices sequentially move to a development position where the development device faces a photosensitive drum which serves as an image carrier. Consequently, after having made an electrostatic latent image on the photosensitive drum visible as a toner image, the development device located at the development position transfers the toner image to an intermediate transfer body, or the like. These operations are sequentially repeated such that the toner images formed by the respective development devices are superposed on the other on the intermediate transfer body or the like, so that a transfer image corresponding to the color image is formed on the intermediate transfer body or the like.

In the electrophotographic image forming apparatus, the electrostatic latent image on the photosensitive drum is generally made visible as a toner image. Accordingly, the concentration of toner and the amount of remaining toner greatly affect the image quality of a formed image. In view of this, an image forming apparatus, which has a rotary unit and is compatible with a color image, has hitherto been proposed to detect and monitor, by means of a custom-designed sensor, or the like, the concentration of toner or the amount of remaining toner; to read information inherent to the development device (toner attribute information, operation history information, and the like) from a noncontact information medium belonging to the development device; and to perform control operation on the basis of the read information, to thereby maintain the image quality of the formed image well.

However, in relation to an image forming apparatus having a related-art rotary unit, the apparatus performs detection of a state or acquisition of information pertaining to a single matter; for instance, only the concentration of toner in a case where the apparatus detects the concentration of toner, or only the amount of remaining toner in a case where the apparatus detects the amount of remaining toner. The result of state detection or acquisition of information is used for maintaining the image quality of a formed image. Consequently, elaborate and flexible response cannot always be realized.

In this regard, detection of a state or acquisition of information can be considered to be performed in relation to a plurality of matters. Detection of a state and acquisition of information requires a stop of rotation of the rotary unit for each object of the detection. Therefore, an increase in the number of matters, which are to be subjected to detection of a state or acquisition of information, may result in a corresponding drop in productivity pertaining to formation of an image.

SUMMARY OF THE INVENTION

The present invention has been made in view of above circumstances and provides an image forming apparatus.

According to an aspect of the present invention, there is provided an image forming apparatus including: a rotary unit that includes a rotary shaft, and a plurality of development devices each of which includes a constituent unit, the development devices provided around the rotary shaft; and a plurality of state detection units that detects at least one of states of the development devices and states of the constituent unit; wherein the rotary unit is rotated so that the development devices sequentially pass a development position facing a photosensitive member; wherein when any of the development devices is located at the development position, the development device makes an electrostatic latent image on the photosensitive member visible; and wherein each of the state detection units detects at least one of the states of the development devices and the states of the constituent unit during a single stop of rotation of the rotary unit.

BRIEF DESCRIPTION OF THE DRAWINGS

Embodiments of the present invention will be described in detail based on the following figures, wherein.

DETAILED DESCRIPTION OF THE INVENTION

An image forming apparatus according to embodiments of the present invention will be described herein below by reference to the drawings.

First Embodiment

Figure 1A:
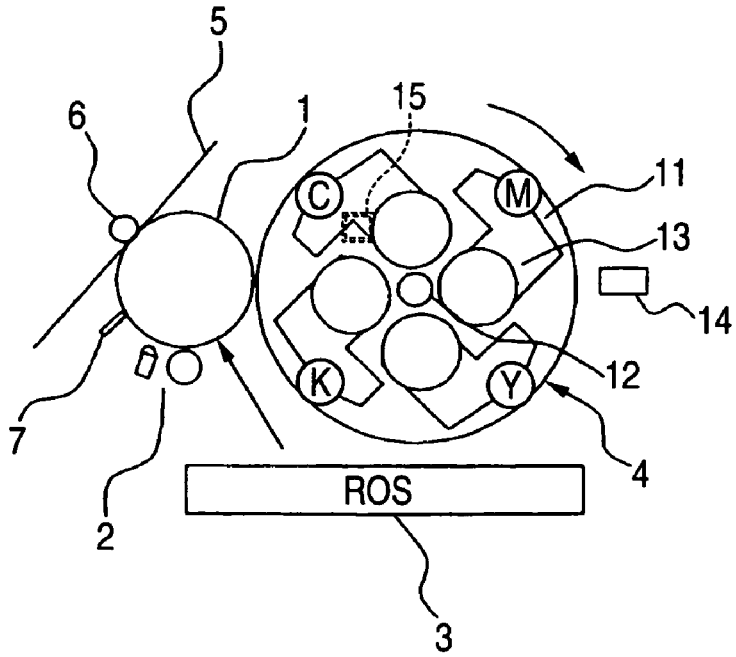
FIGS. 1A and 1B are descriptive views showing the principal configuration of an image forming apparatus according to a first embodiment of the present invention.
Figure 1B:
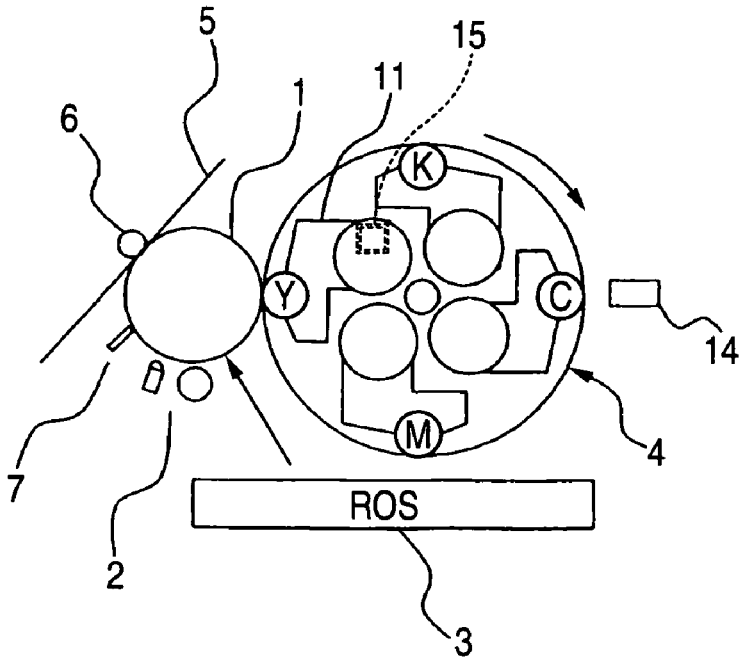

FIGS. 1A and 1B are descriptive views showing the principal configuration of an image forming apparatus according to a first embodiment of the present invention. As illustrated, the image forming apparatus to be described herein includes a photosensitive drum 1 serving as an image carrier; an electrifying device 2 for electrifying the photosensitive drum 1; an ROS (Raster Output Scanner) 3 which writes an electrostatic latent image on the photosensitive drum 1 through exposure; a rotary unit 4 having a development device for making an electrostatic latent image on the photosensitive drum 1 visible as a toner image; a transfer device 6 for transferring the toner image on the photosensitive drum 1 onto an intermediate transfer belt 5; and a cleaning device 7 for removing the toner remaining on the photosensitive drum 1.

The rotary unit 4 has four development devices 11 assigned to respective Y, M, C, K color components so as to enable formation of a color image, and has the development devices 11 disposed around a rotary shaft 12. As a result of the rotary unit 4 rotating around the rotary shaft 12, the respective development devices 11 rotate in an integrated fashion. Rotation of the rotary unit 4 is performed by an unillustrated drive source such as a motor, and rotational driving of the rotary unit 4 is controlled by rotation control unit, such as a motor controller or the like, which is also unillustrated. Specifically, under drive control of the rotation control unit, the rotary unit 4 starts rotation and stops at a desired position. In relation to the technique for controlling driving of the rotary unit 4 performed by the rotation control unit, a known technique is preferably employed, and therefore its explanation is omitted.

Each of the development devices 11 attached to the rotary unit 4 employs toner which is, e.g., a well-known two-component developing agent for making the electrostatic latent image on the photosensitive drum 1 visible. Therefore, each of the development devices 11 has a toner cartridge 13, as a constituent unit of the development device, for storing toner assigned to one of color components Y (yellow), M (magenta), C (cyan), and K (black). In order to facilitate replenishment of toner, the toner cartridge 13 is configured to be removably attached to the development device 11. The development device 11 is also configured so as to be removably attached to the rotary unit 4 in order to facilitate maintenance of the development device. The mechanism that enables removable attachment of a toner cartridge is realized by utilization of the well-known technique. Therefore, its explanation is omitted.

The respective development devices 11 attached to the rotary unit 4 are provided around the rotary unit 4 such that an arrangement pitch on the circumference of the rotary unit 4 becomes uniform. Specifically, the number of development devices 11 attached to the rotary unit 4 is four, and hence the circumferential length of the rotary unit 4 is split into four uniform lengths by these development devices 11.

Moreover, each of the development devices 11 provided in the rotary unit 4 is arranged to be driven at the development position. Here, the term "development position" is a position which faces the photosensitive drum 1 and where the respective development devices 11 sequentially move and stop for making the electrostatic latent image on the photosensitive drum 1 visible. Namely, the development device 11 located at the development position is driven at the development position, and the electrostatic latent image on the photosensitive drum 1 is made visible at that development position. Driving of the development device 11 also employs an auger (of vane type or the like) provided for transporting toner in the toner cartridge 13.

However, when the electrostatic latent image on the photosensitive drum 1 is made visible by the toner image, the concentration of toner, the amount of remaining toner, and the like greatly affect the image quality achieved through image formation. For this reason, the image forming apparatus to be described herein has a state detection unit that detects either the state of the development devices 11 attached to the rotary unit 4 or the state of constituent units of the development devices 11.

Here, the term "state of the development devices 11" refers to the state of a matter which affects operation for making an electrostatic latent image visible. Specifically, the state includes the concentration of toner used for making an electrostatic latent image visible, the amount of remaining toner, presence/absence of the development device 11 in the rotary unit 4, specifics of attribute information stored in the development devices 11, and the like.

Similar to the case of the state of the development devices 11, the term "state of the constituent units of the development devices 11" refers to the state of a matter which affects the operation for making an electrostatic latent image visible. Specifically, the state of the constituent units includes the presence/absence of the toner cartridges 13 constituting the development devices 11, the amount of remaining toner in the toner cartridge, specifics of attribute information stored in the toner cartridges, and the like.

The requirement for the state detection unit is to be a detection unit which detects at least either the state of the development devices 11 or the state of the constituent units of the development devices 11. Specifically, the state detection unit may be a detection unit which detects the state of only the development devices 11, a detection unit which detects the state of only the constituent units of the development devices 11, or a detection unit which detects both the state of the development devices 11 and that of the constituent units of the same.

Specifically, the image forming apparatus has, as state detection unit, a toner concentration detection sensor 14 and a radio communication antenna 15.

The toner concentration detection sensor 14 functions as one of the above-described state detection unit by means of detecting the concentration of toner. Specifically, a diffused light sensor disposed at a position above the outer circumference of the rotary unit 4 is used to thus detect, in a noncontacting manner, the concentration of toner of each development device 11 located at the detection position where the development device faces the diffused light sensor. As a matter of course, another well-known technique other than the diffused light sensor may be utilized for detecting the concentration of toner.

The radio communication antenna 15 reads the attribute information stored in and retained by the development devices 11, to thus act as another one of the above-described state detection unit. Specifically, an antenna, which is employed as electromagnetic communication means, is provided in the vicinity of the rotary unit 4. A radio wave emitted from the antenna is converted into energy, whereby data are exchanged, in a noncontacting manner, with memory of the development device 11 located at the detection position where the development device faces the antenna. Thus, the attribute information stored in the memory is detected. The attribute information stored in memory includes, e.g., information about characteristics of toner, such as a manufacturing lot of toner stored in the toner cartridge 13, the amount of toner filled in the toner cartridge, the date of manufacture of toner, a shape factor of toner, a mean particle size, an initial physical characteristic (an electrifying characteristic), and the like. These pieces of manufacturing information have already been written in memory upon shipment of a product from the factory. In addition, the attribute information includes information about the amount of consumed toner, the amount of remaining toner, deterioration of a developing agent, or the like, which can be specified from history information; e.g., the number of images processed by the image forming apparatus (a development device or toner cartridge), an operation time of the image forming apparatus, or the like. The pieces of information are assumed to be written into memory as appropriate in accordance with operating statues of the apparatus. Namely, the attribute information may have been written in memory in advance, or may be written into memory according to the operating condition of the image forming apparatus. Exchange of data by way of the radio communication antenna 15 is realized by utilization of the well-known technique, and hence its explanation is omitted here.

As mentioned above, in order to detect the state of the development device 11 or the state of the toner cartridge 13 thereof, the image forming apparatus described hereinbelow has the toner concentration detection sensor 14 and the radio communication antenna 15; namely, a plurality of state detection unit. As will be described in detail later, the toner concentration detection sensor 14 and the radio communication antenna 15 are arranged so as to be able to detect a state during a single stop of rotation of the rotary unit 4.

An example processing operation of the image forming apparatus having the above configuration will now be described.

In the image forming apparatus to be described herein, the rotary unit 4 remains stationary at the home position where none of the development devices 11 face the photosensitive drum 1, in order to lessen the load on the photosensitive drum 1, or the like, before commencement of processing operation; namely, during a stop of the apparatus (see FIG. 1A).

When image forming operation is started, the rotary unit 4 starts rotation in, e.g., a clockwise direction in the drawing, pursuant to drive control performed by the rotation control unit, and the rotation is continued until the development device 11 assigned to the Y-color component reaches the development position. When the development device 11 assigned to the Y-color component has moved to the development position and stopped at the development position while facing the photosensitive drum 1 (see FIG. 1B), driving of the development device 11 located at that development position is started, whereby an electrostatic latent image on the photosensitive drum 1 is made visible as a toner image of Y-color component.

In a state where the development device 11 assigned to the Y-color component is situated at the development position, the radio communication antenna 15 can exchange data with the memory of the development device 11 that is located at the development position and assigned to the Y-color component. Moreover, the toner concentration detection sensor 14 can detect the concentration of toner of the development device 11 of C-color component that is located at a position opposing the development device 11 of the Y-color component with the rotary shaft 12 interposed therebetween (see FIG. 1B). Accordingly, simultaneously with the development device 11 assigned to the Y-color component making the electrostatic latent image visible in the development position, the radio communication antenna 15 detects the state of the development device 11 assigned to the Y-color component or the state of the toner cartridge 13 of that development device. The toner concentration detection sensor 14 detects the state of the development device 11 assigned to the C-color component or the state of the toner cartridge 13. A result of state detection is delivered to the control section that controls overall operation of an unillustrated image forming apparatus, and is used for maintaining image quality on image to be formed.

Subsequently, the rotation of the rotary unit 4 is repeatedly resumed and stopped such that the development devices 11 assigned to the M-color component, the C-color component, and the K-color component perform, at the development position, operation for making an electrostatic latent image visible. Every time any one of the development devices 11 comes to a stop at the development position, the toner concentration detection sensor 14 and the radio communication antenna 15 perform detection of a state.

After formation of color images has been completed by operation for making electrostatic latent images of all colors visible and all pages, on which images are to be formed, have undergone formation of the color images, the rotary unit 4 stops rotation while remaining at the home position (see FIG. 1A) and enters, a standby condition for awaiting the next processing operation.

Second Embodiment

A second embodiment of the present invention will now be described. An explanation is given solely to a difference between the first embodiment and the second embodiment.

Figure 2A:
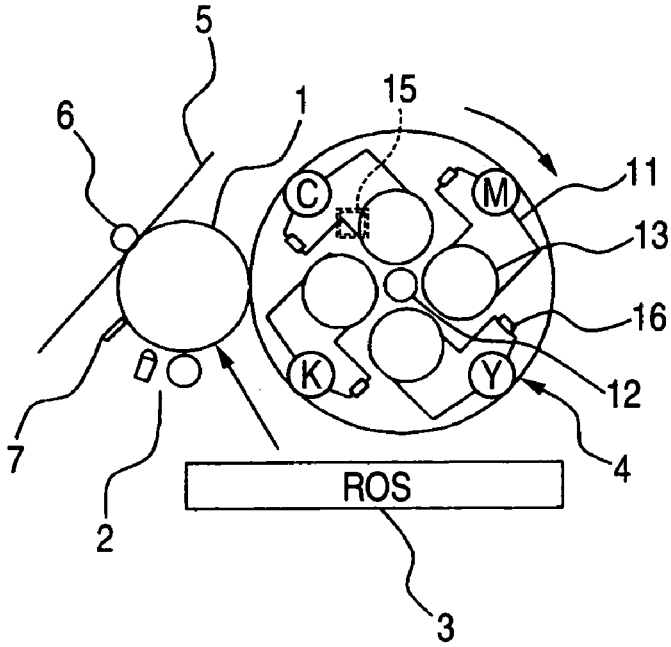
FIGS. 2A and 2B are descriptive views showing the principal configuration of an image forming apparatus according to a second embodiment of the present invention.
Figure 2B:
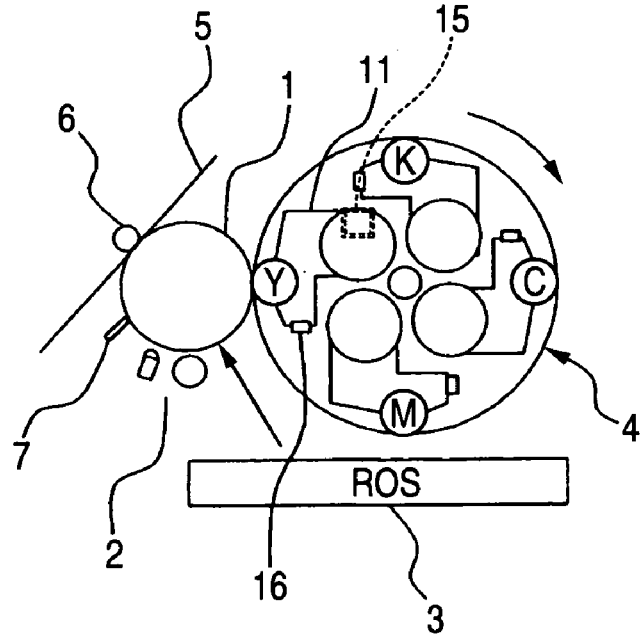

FIGS. 2A and 2B are descriptive views showing the principal configuration of an image forming apparatus according to the second embodiment of the present invention. As illustrated, the image forming apparatus described herein is provided with toner concentration detection sensors 16 which are individually attached to the respective development devices 11 set in the rotary unit 4. The second embodiment differs from the first embodiment in that the toner concentration detection sensors 16 are provided in place of the toner concentration detection sensor 14 described in connection with the first embodiment.

The toner concentration detection sensor 16 is a sensor for detecting the concentration of toner in the development device 11 by means of permeability. As a matter of course, the concentration of toner may be detected by utilization of a known technique other than a permeability sensor.

In the image forming apparatus described herein, each of the development devices 11 is provided with the toner concentration detection sensor 16. The respective toner concentration detection sensors 16 do not simultaneously perform detection of a state, but any one of the toner concentration detection sensors 16 is supposed to selectively perform state detection. Specifically, only the toner concentration detection sensor 16 attached to the development device 11 that is located at the development position performs state detection. Such selective detection of a state can be embodied by exchanging signals between the respective toner concentration detection sensors 16 and an unillustrated electrode provided on the main body of the image forming apparatus, as in the case of state detection performed by the radio communication antenna 15. Specifically, when any one of the development devices 11 is situated at the development position, exchange of signals between the toner concentration detection sensor 16 provided on that development device 11 and the electrode is made possible.

As mentioned above, in the image forming apparatus described herein, the radio communication antenna 15 and the toner concentration detection sensors 16 function as a plurality of state detection units. In contrast with the first embodiment, the radio communication antenna 15 and the toner concentration detection sensors 16 detect the state of the same development device 11 located at the development position or the state of the toner cartridge 13 of that development device.

Example processing operation of the image forming apparatus having the above configuration will now be described.

Even in the image forming apparatus described herein, the rotary unit 4 remains stationary at the home position before commencement of processing operation (see FIG. 2A).

When image forming operation is initiated, the rotary unit 4 starts rotation. When the development device 11 assigned to the Y-color component has arrived at the development position, the rotation of the rotary unit 4 is stopped (see FIG. 2B). In that development position, the development device 11 assigned to the Y-color component makes the electrostatic latent image visible. Simultaneously with operation for making the electrostatic latent image visible, the radio communication antenna 15 detects the state of the development device 11 assigned to the Y-color component, or the state of the toner cartridge 13 of that development unit. Further, the toner concentration detection sensor 16 attached to the development device 11 assigned to the Y-color component detects the state of the development device 11 of the Y-color component or the state of the toner cartridge 13 of that development device. These processing operations are repeated until the operations are completed in relation to the M-color component, the C-color component, and the K-color component. After processing of all pages on which images are to be formed has been completed, the rotary unit 4 stops rotation while remaining at the home position (see FIG. 2A), and enters a standby condition for awaiting the next processing operation.

Third Embodiment

A third embodiment of the present invention will now be described. An explanation is given solely to a difference between the third embodiment and the first or second embodiment.

Figure 3A:
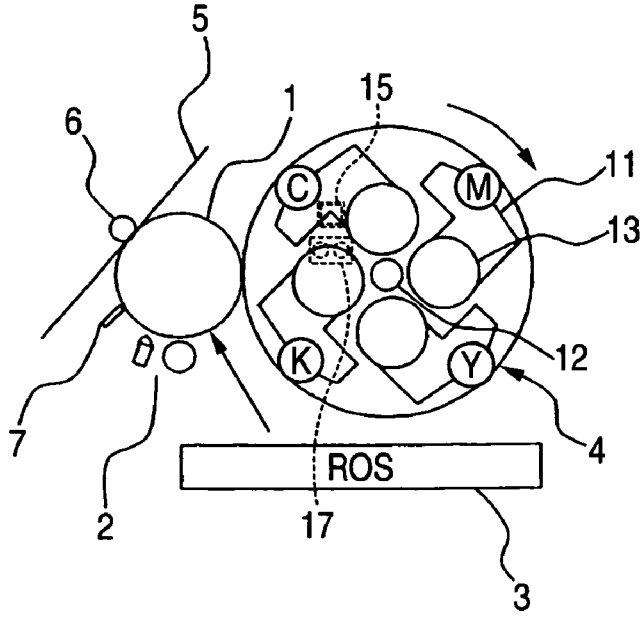
FIGS. 3A and 3B are descriptive views showing the principal configuration of an image forming apparatus according to a third embodiment of the present invention.
Figure 3B:
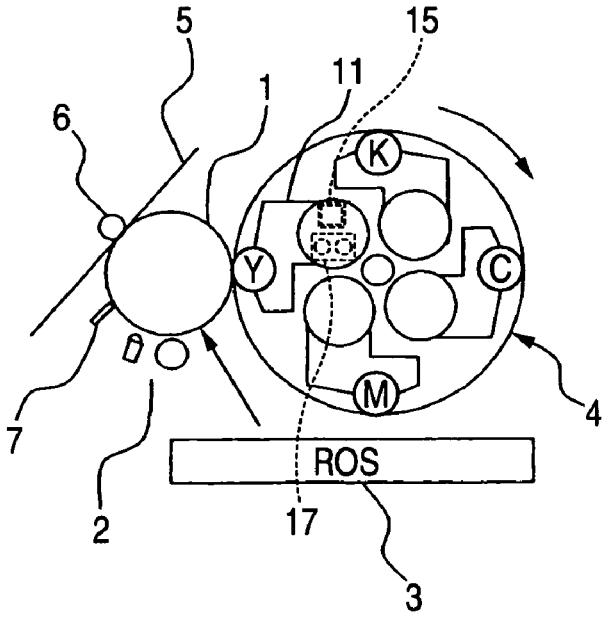

FIGS. 3A and 3B are descriptive views showing the principal configuration of an image forming apparatus according to the third embodiment of the present invention. As illustrated, the image forming apparatus described herein differs from the image forming apparatus described in connection with the first embodiment in that the image forming apparatus is provided with a remaining toner detection sensor 17 in place of the toner concentration detection sensor 14 described in connection with the first embodiment.

The remaining toner detection sensor 17 functions as one of the state detection units by means of detecting the amount of remaining toner. Specifically, the amount of toner remaining in the toner cartridges 13 is detected in a noncontacting manner by utilization of a transmission optical sensor provided in the vicinity of the rotary unit 4, and transparent windows provided in the toner cartridges 13 of the respective development devices 11. Alternatively, there can also be conceived use of a sensor which determines whether or not a contact body serving as an electrical resistor is present, by utilization of the ability of a commonly-utilized remaining quantity sensor to detect vibration of a sensing face and a phenomenon of vibration being prevented by presence of a powder (toner) contacting the sensing face. Specifically, the amount of remaining toner may be detected by utilization of a known technique other than the transmission optical sensor.

As in the case of the above-described radio communication antenna 15 or the toner concentration detection sensor 16, the remaining toner detection sensor 17 is arranged to detect, when any development device 11 is situated at the development position, the amount of toner remaining in the toner cartridge 13 of the development device 11.

In the image forming apparatus described herein, the radio communication antenna 15 and the remaining toner detection sensor 17 function as a plurality of state detection units. The radio communication antenna 15 and the remaining toner detection sensor 17 detect the state of the same development device 11 situated at the development position or the state of the toner cartridge 13 of that development device, as in the case of the second embodiment.

Subsequently, example processing operation of the image forming apparatus having the above configuration will now be described.

Even in the image forming apparatus described herein, the rotary unit 4 remains stationary at the home position before commencement of processing operation (see FIG. 3A).

When image forming operation is then initiated, the rotary unit 4 starts rotation. When the development device 11 assigned to the Y-color component has arrived at the development position, the rotation of the rotary unit 4 is stopped (see FIG. 3B). At that development position, the development device 11 assigned to the Y-color component makes the electrostatic latent image visible. Simultaneously with operation for making the electrostatic latent image visible, the radio communication antenna 15 detects the state of the development device 11 assigned to the Y-color component or the state of the toner cartridge 13 of that development unit. Further, the remaining toner detection sensor 17 detects the state of the development device 11 of the Y-color component or the state of the toner cartridge 13 of that development device. These processing operations are repeated until the operations are completed in relation to the M-color component, the C-color component, and the K-color component. After processing of all pages on which images are to be formed has been completed, the rotary unit 4 stops rotation while remaining at the home position (see FIG. 3A), and enters a standby condition for awaiting the next processing operation.

As has been described above, any one of pieces of the image forming apparatus of the first through third embodiments detects the state of the development device 11 or the toner cartridge 13 thereof, by use of a plurality of state detection units. The respective state detection units are arranged so as to be able to detect the states during a single stop of rotation of the rotary unit 4. Consequently, state detection is performed in connection with a plurality of matters by use of a plurality of state detection units. This can be used for maintaining the image quality of an image to be formed. When compared with a case where state detection is performed solely in connection with the single matter, elaborate and flexible response can be realized. Even in such a case, state detection can be performed during a single stop of rotation of the rotary unit 4. Individual stops of rotation of a rotary unit 4 for respective state detection operations are not required.

Hence, formation of a superior image can be realized by means of detecting the state of the development device 11, or the like, and occurrence of a drop in productivity pertaining to image formation can also be prevented while elaborate, flexible maintenance of image quality of a formed image is being performed. Specifically, there can be prevented occurrence of an inappropriate state (occurrence of an imperfection in image quality or the like) pertaining to image formation or occurrence of a state where formation of an image is not possible without involvement of a drop in productivity pertaining to image formation.

As described in connection with the first through third embodiments, the rotary unit 4 stops its rotation when any one of the plurality of development devices 11 is situated at the development position, and detects the state of the development device in the stopped state by use of the plurality of state detection units. Namely, in conjunction with stopping the rotation for making the electrostatic latent image visible at the development position, a state is also detected by use of the state detection unit. Consequently, even when a plurality of matters is subjected to state detection, respective state detection operations do not require rotation of the rotary unit. The state detection operations can be performed in conjunction with stoppage of the rotation for making an electrostatic latent image visible. Hence, the embodiment is very suitable for preventing occurrence of a drop in productivity pertaining to formation of an image.

Moreover, the state of the development device 11 located at the development position or the state of the toner cartridge 13 thereof is detected. Therefore, state detection operation can be performed during driving of the development device 11 or the toner cartridge 13 thereof. Even in the case of a physical quantity about which highly-precise information can be obtained by performing detection operation during the driving state of the development device, sufficient detection accuracy can be attained.

As described in connection with the second and third embodiments, so long as each of the state detection unit detects the state of the same development device 11 or the state of the toner cartridge 13 thereof, even when state detection is performed in connection with a plurality of matters during a single stop of rotation of the rotary unit 4, the state detection performed during a single stop of rotation of the rotary unit 4 is directed toward a single color component. Since a result of detection of the state of a single color component is obtained simultaneously, an attempt can be made to facilitate processing or lessen load required when the results of state detection are utilized for maintaining the image quality of a formed image.

As described in connection with the second and third embodiments, so long as the plurality of state detection units detect the state of the same development device 11 located at the development position or the state of the toner cartridge 13 thereof during a single stop of rotation of the rotary unit 4 as well as detecting the state of the same development devices, improved accuracy of detection can be expected by means of detecting operation performed in the driving state of the development device. In addition, even in the case of a so-called monochrome print, the image forming apparatus can produce the print appropriately. For instance, even when formation of a monochrome image, which does not involve rotation of the rotary unit 4, is performed, the state of the development device 11 of that monochrome component or the state of the toner cartridge 13 thereof can be detected.

In the first through third embodiments, preferred specific examples of the present invention have been described by citing various example configurations and example processing operations. However, the present invention is not limited to the specifics of the examples.

For instance, in relation to the timing at which the plurality of state detection units perform state detection, no particular limitation is imposed on detailed timing, so long as the plurality of state detection units perform state detection operations during a single stop of rotation of the rotary unit 4.

For instance, in a case where at least one of the state detection units utilizes radio communication, as in the case of the radio communication antenna 15, the plurality of state detection units desirably perform state detection at different timings during a single stop of rotation of the rotary unit 4. The reason for this is to prevent noise, or the like, which would otherwise be induced by certain state detection unit performing state detection operation, from adversely affecting the result of state detection performed by another state detection unit, by means of preventing state detection operations from being performed at the same timing.

The first through third embodiments have described a case where one of the plurality of state detection units reads specifics of the attribute information by utilization of the radio communication antenna 15. However, in addition to reading information or in place of reading information, writing attribute information is also conceivable. Information to be written in that case is to be specified on the basis of the result of state detection performed by another state detection units or attribute information managed by the main body of the image forming apparatus. Specifically, in addition to including the plurality of state detection units or in place of a part of the state detection, the image forming apparatus of the present invention may have information writing unit that writes, into the memory of the development device 11, information about the state of the development device 11 or the state of the toner cartridge 13 thereof. The state detection unit and the information writing unit may be arranged so as to be able to perform state detection and writing of information during a single stop of rotation of the rotary unit 4.

As mentioned above, specific examples of a plurality of state detection unit or a specific example of information writing unit are not limited to those described in connection with the above embodiments. The state detection unit and the information writing unit are conceived to be constructed by appropriate combination of an optical toner concentration sensor, a magnetic toner concentration sensor, a remaining toner sensor, a development device availability detection sensor, a toner cartridge availability detection sensor, data exchange means utilizing radio communication, and the like.

Fourth Embodiment

The above-described first through third embodiments have described the case where the respective development devices 11 set in the rotary unit 4 are arranged over the circumference of the rotary unit 4 at uniform pitches. However, the present invention is also applicable to a case where the development devices are arranged at nonuniform pitches.

Now, an example where the development devices 11 are arranged at nonuniform pitches will be described as a fourth embodiment of the present invention. FIG. 4 is a descriptive view showing the principal configuration of the image forming apparatus of the fourth embodiment of the present invention.

In general, the image forming apparatus compatible with a color image may form a monochrome image as well as a color image. Therefore, the amount of consumed toner of YMCK color components is not necessarily constant. Therefore, an increase in the volume of the toner cartridge in the development device pertaining to a color component whose toner is consumed in large quantity is effective for diminishing the frequency of replenishment of toner.

Figure 4A:
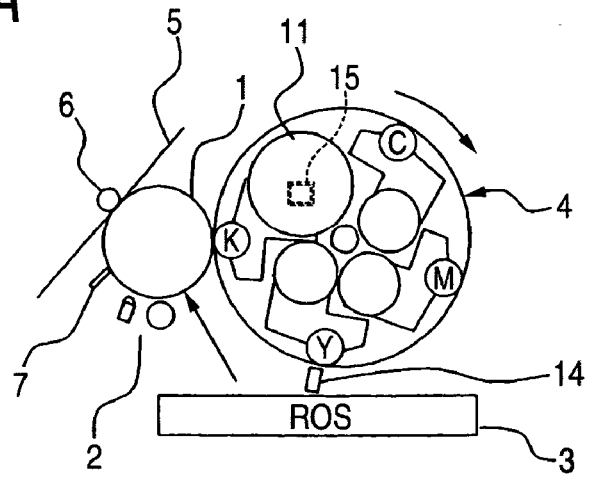
FIGS. 4A to 4C are descriptive views showing the principal configuration of an image forming apparatus according to a fourth embodiment of the present invention.

Therefore, as shown in FIG. 4A, in the image forming apparatus to be described here, the volume of the toner cartridge 13 of the development device 11 assigned to a color component which is consumed in large quantity; specifically, the K-color component, is made larger than the volume of the toner cartridges of the development devices 11 assigned to the other color components. Therefore, the arrangement pitches of the respective development devices 11 become nonuniform while the development devices 11 are attached to the rotary unit 4.

Even in such an image forming apparatus having such a configuration, for instance, the toner concentration detection sensor 14 and the radio communication antenna 15 serve as a plurality of state detection units. Specifically, in a state where the development device 11 assigned to the K-color component is situated at the development position, the radio communication antenna 15 exchanges data with memory belonging to the development device 11 that is located at the development position and assigned to the K-color component. Further, the toner concentration detection sensor 14 detects the concentration of toner in the development device 11 assigned to the Y-color component (see FIG. 4A). Thereby, the toner concentration detection sensor 14 and the radio communication antenna 15 perform state detection operations during a single stop of rotation of the rotary unit 4.

Figure 4B:
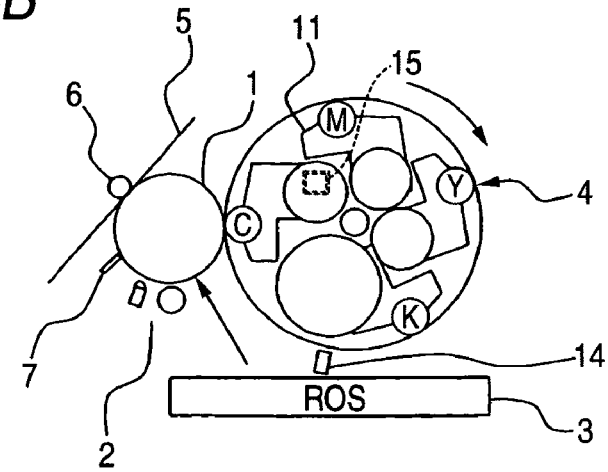

However, when the arrangement pitches of the respective development devices 11 are nonuniform; for example, when the development device 11 assigned to the C-color component is located at the development position, the development device 11 that is located at the detection position facing the toner concentration detection sensor 14 and is assigned to the K-color component is not present (see FIG. 4B). Therefore, the toner concentration detection sensor 14 does not detect the concentration of toner in relation to the development device 11 assigned to the K-color component. Since the K-color component less affects formation of a color image rather than do the other color components (formation of a color image is possible even when the K-color component is not available), adverse effects on maintaining the image quality of a formed image superior can be minimized even when detecting the state of the K-color component is omitted. However, in order to maintain high image quality of the K-color component, another sensor for detecting the concentration of toner of the development device 11 assigned to the K-color component may also be provided.

Figure 4C:
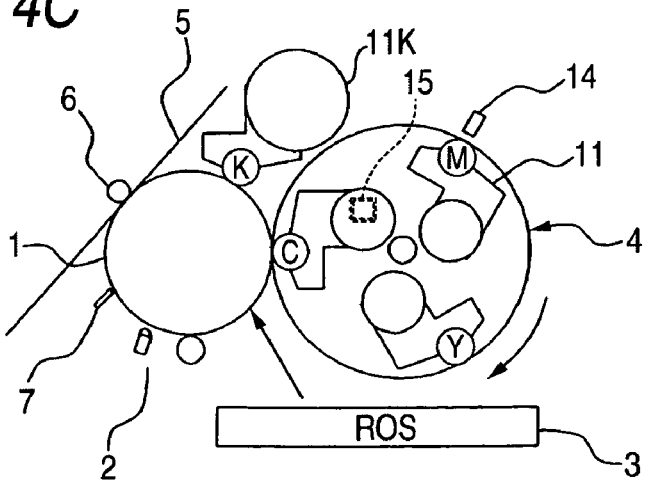

As shown in, e.g., FIG. 4C, even in an image forming apparatus where the development device 11 K assigned to the K-color component is provided not in but independently of the rotary unit 4 and where the development devices 11 assigned to the other color components YMC are arranged on the rotary unit 4 at uniform pitches, the toner concentration detection sensor 14 and the radio communication antenna 15 detect the states of the Y-color component, the M-color component, and the C-color component during a single stop of rotation of the rotary unit 4.

As mentioned above, the embodiments of the present invention is susceptible to modifications of the embodiments within the scope of the gist of the present invention.

The entire disclosure of Japanese Patent Application No. 2005-185952 filed on Jun. 27, 2005 including specification, claims, drawings and abstract is incorporated herein be reference in its entirety.

What is claimed is:

1. An image forming apparatus comprising:

a rotary unit that includes a rotary shaft, and a plurality of development devices each of which includes a constituent unit, the development devices provided around the rotary shaft; and a plurality of state detection units;

wherein the rotary unit is rotated so that the development devices sequentially pass a development position facing a photosensitive member;

wherein when the rotary unit stops rotating and when any of the development devices is located at the development position, the development device makes an electrostatic latent image on the photosensitive member visible; and wherein during a single stop of the rotation of the rotary unit, each of the state detection units detects a state of one of the development devices or a state of one of the constituent units.

2. The image forming apparatus according to claim 1, wherein the single stop of rotation of the rotary unit occurs when one of the development devices is located at the development position.

3. The image forming apparatus according to claim 1, wherein the rotary unit makes a single stop of rotation when the one of the development devices is located at the development position.

4. The image forming apparatus according to claim 1, wherein, during the single stop of rotation, the state detection units detect the respective states of one of the development devices or the respective states of one of the constituent units.

5. The image forming apparatus according to claim 1, wherein the rotary unit makes the single stop of the rotation when the one of the development devices is located at the development position; and wherein, during the single stop of rotation, each of the state detection units detects at least one of (i) the corresponding state of the development device located at the development position and (ii) the corresponding state of the constituent unit of the development device located at the development position.

6. The image forming apparatus according to claim 1, wherein the plurality of state detection units respectively perform the state detection at different timings during the single stop of rotation.

7. The image forming apparatus according to claim 1, further comprising:

an information writing unit;

wherein during the single stop of rotation of the rotary unit, the information writing unit writes information pertaining to a state of one of the development devices or a state of the constituent unit of one of the development devices into a memory provided in the one of the development devices.

8. An image forming apparatus comprising:

a rotary unit that includes a rotary shaft, and a plurality of development devices each of which has a constituent unit, the development devices provided around the rotary shaft;

a first state detection unit; and a second state detection unit; wherein the rotary unit is rotated so that the development devices sequentially pass a development position facing a photosensitive member;

when the rotary unit stops rotating and when any of the development devices is located at the development position, the development device makes an electrostatic latent image on the photosensitive member visible; and during a single stop of rotation of the rotary unit, the first state detection unit detects a state of the development device located at a first position while the second state detection unit detects a state of the constituent unit located at a second position.

9. The image forming apparatus according to claim 8, wherein the state contacted by the first state detection unit indicates (i) a concentration of a toner used to make the elastic latent image visible, (ii) whether or not the development device to be detected by the first state detection unit is attached to the rotary unit and (iii) attribute information stored in the development device to be detected by the first state detection unit, and the state detected by the second state detection unit indicates (i) whether or not the constituent unit to be detected by the second state detection unit is attached to the development device, (ii) an amount of the remaining toner in the constituent unit to be detected by the second state detection unit and (iii) attribute information stored in the constituent unit to be detected by the second state detection unit.

10. The image forming apparatus according to claim 8, wherein when one of the development devices is located at the first position and when one of the constituent units is located at the second position, the one of the development devices is different from the development device having the one of the constituent unit.

11. The image forming apparatus according to claim 8, wherein when one of the development devices is located at the first position and when one of the constituent units is located at the second position, the one of the development devices has the one of the constituent units.

12. The image forming apparatus according to claim 8, wherein the constituent units are toner cartridges.

* * * * *